US008277186B2

(12) United States Patent
Tanaka

(10) Patent No.: US 8,277,186 B2
(45) Date of Patent: Oct. 2, 2012

(54) TURBINE BLADE ASSEMBLY AND STEAM TURBINE

(75) Inventor: Osamu Tanaka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 645 days.

(21) Appl. No.: 12/470,264

(22) Filed: May 21, 2009

(65) Prior Publication Data

US 2009/0290983 A1 Nov. 26, 2009

(30) Foreign Application Priority Data

May 26, 2008 (JP) ..... 2008-137301

(51) Int. Cl.
*F01D 5/22* (2006.01)

(52) U.S. Cl. ..... 416/179; 416/204 R; 416/220 R; 416/219 R; 416/248; 415/220

(58) Field of Classification Search ..... 416/179, 416/220 R, 204 R, 219 R, 248; 415/220
See application file for complete search history.

(56) References Cited

U.S. PATENT DOCUMENTS

| | | | | |
|---|---|---|---|---|
| 2,867,408 | A * | 1/1959 | Bolter et al. | 416/220 R |
| 3,037,741 | A * | 6/1962 | Tuft | 416/221 |
| 3,904,317 | A * | 9/1975 | Cardin et al. | 416/220 R |
| 3,930,751 | A * | 1/1976 | Straslicka et al. | 416/220 R |
| 5,720,596 | A * | 2/1998 | Pepperman | 416/220 R |
| 6,464,463 | B2 * | 10/2002 | Yvon Goga et al. | 416/215 |
| 6,638,006 | B2 * | 10/2003 | Selby | 415/9 |
| 6,752,598 | B2 * | 6/2004 | Antunes et al. | 416/215 |
| 6,981,847 | B2 * | 1/2006 | Arinci et al. | 416/193 A |
| 7,467,925 | B2 * | 12/2008 | Schroder | 416/220 R |
| 2006/0002798 | A1 | 1/2006 | Ooishi et al. | |
| 2006/0222501 | A1 | 10/2006 | Nogami et al. | |

FOREIGN PATENT DOCUMENTS

| | | | |
|---|---|---|---|
| EP | 1 512 837 | A1 | 3/2005 |
| EP | 1 707 748 | A2 | 10/2006 |
| JP | 09-177502 | A | 7/1997 |
| JP | 2000-018002 | A | 1/2000 |
| JP | 2004-052757 | A | 2/2004 |
| JP | 2006-283681 | A | 10/2006 |

* cited by examiner

*Primary Examiner* — Igor Kershteyn
(74) *Attorney, Agent, or Firm* — Foley & Lardner LLP

(57) ABSTRACT

A turbine blade 10*a* which is a stop blade is provided with a cutout portion 50 which is formed in one circumferential side surface 22*a* of a shank portion 22 at the center in the axial direction of a turbine rotor 100, a cutout portion 60 which is formed in one circumferential side surface 22*a* of the shank portion 22 from one end portion 22*b* to the cutout portion 50 in the axial direction of the turbine rotor 100, and a through passage 70 which is formed to pass from the cutout portion 50 to an effective blade part and in which a moving member 170, which moves a stopper member 160 to the effective blade part in the cutout portion 50, is inserted.

4 Claims, 17 Drawing Sheets

TURBINE BLADE ASSEMBLY AND STEAM TURBINE

CROSS-REFERENCE TO RELATED APPLICATIONS

This application is based upon and claims the benefit of priority from the prior Japanese Patent Application No. 2008-137301 filed on May 26, 2008; the entire contents of which are incorporated herein by reference.

BACKGROUND

1. Field of the Invention

The present invention relates to a steam turbine used for thermal power generation and the like, and more particularly to a turbine blade assembly which is provided with axial inserted blade root type turbine blades which have blade root portions implanted by inserting in an axial direction of a turbine rotor and to a steam turbine provided with it.

2. Description of the Related Art

For the turbine blade, for example, strength design against high centrifugal forces, and vibration design to suppress the occurrence of resonant oscillation of the turbine blade due to an external force such as steam are important in addition to fluid design as a steam passage component element.

For the strength design, a connected portion structure with a turbine blade to be attached to an outer peripheral tip end of a rotor blade wheel of the turbine rotor is most important, and generally connected via a blade root portion which is formed by concavo-convex interlocking. The blade root fitting structure is divided roughly into two systems of a saddle-shaped blade root type and an axial inserted blade root type and being used extensively as disclosed in, for example, JP-A 9-177502 (KOKAI) and JP-A 2006-283681 (KOKAI).

FIG. 14 is a perspective view showing a rotor blade wheel 300 and turbine blades 310 to illustrate a blade root fitting structure according to a conventional saddle-shaped blade root type. FIG. 15 is a perspective view showing a rotor blade wheel 350 and turbine blades 360 to illustrate a blade root fitting structure according to a conventional axial inserted blade root type. FIG. 16 is a diagram showing a cross section of the rotor blade wheel 300 and the turbine blade 310 according to the conventional saddle-shaped blade root type viewed in a turbine rotor axial direction. FIG. 17 is a diagram showing a cross section of the rotor blade wheel 350 and the turbine blade 360 according to the conventional axial inserted blade root type viewed in a turbine rotor axial direction. FIG. 18 is a plan view of the rotor blade wheel 350 and the turbine blades 360 with stop blades fixed with screws viewed in the turbine rotor axial direction according to the conventional axial inserted blade root type. FIG. 19 is a plan view showing a structure of shroud portions 390 according to a conventional snubber type blade. FIG. 20 is a diagram showing a cross section of a blade root portion 370*a* of a standard rotor blade 370 and a rotor blade wheel 395 having a structure to control a radial directional position of the snubber type blade. FIG. 21 is a diagram showing a cross section of a blade root portion 380*a* of an offset rotor blade 380 and the rotor blade wheel 395 having a structure to control a radial directional position of the snubber type blade.

As shown in FIG. 14, the saddle-shaped blade root type is a type that the turbine blade 310 is inserted radially onto a cutout portion 301 which is formed at one position in the circumferential direction of the irregularities fabricated in the circumferential direction of the turbine rotor to embrace the rotor blade wheel 300 from the turbine blade side. Meanwhile, as shown in FIG. 15, the axial inserted blade root type is a type that the turbine blades 360 are inserted into the blade grooves of the rotor blade wheel 350 which are formed around the turbine rotor by forming plural blade grooves which are formed to have a recessed shape in the turbine rotor axial direction along the circumferential direction of the turbine rotor.

As shown in FIG. 16 and FIG. 17, when the above blade root types are compared, with respect to width a of the same rotor blade wheels 300, 350 the width of the turbine blades 310, 360 to be combined with them can be made larger for blade width b2 of the axial inserted blade root type than for blade width b1 of the saddle-shaped blade root type. It means that as far as both of them satisfy allowable stress, the turbine blade 310 of the axial inserted blade root type has higher load capability.

Taking the above advantage, the axial inserted blade root type is being used for various types of turbines which need a design to suppress a rotor span, namely a turbine rotor length, to a smaller level. In improvement design to improve the performance of an existing turbine, a change from the saddle-shaped blade root type to the axial inserted blade root type is also made in order to provide a small gap with an important function.

When a specified number of turbine blades are implanted in the rotor blade wheel, the last turbine blade is implanted as the stop blade. For the above-described conventional saddle-shaped blade root type, the stop blade is fixed to the rotor blade wheel by a fixing member 311 such as a fastening screw or a locking pin to prevent it from coming out in a radial direction as shown in FIG. 14.

Meanwhile, according to the above-described conventional axial inserted blade root type, a blade root portion 361 of the turbine blade 360 other than the stop blade which is the last turbine blade is inserted into the groove portion along the turbine rotor axial direction as shown in FIG. 15. And, the turbine blade 360 is inserted to reach a predetermined position, and a stop key 363 is inserted between a cutout portion 362 which is formed in the side surface on the circumferential direction side of the blade root portion 361 and two projections 351 which are formed on the top of the rotor blade wheel 350 between the groove portions. The insertion of the stop key 363 prevents the turbine blade 360 from moving in the turbine rotor axial direction. Thus, the turbine blades 360 other than the stop blade are implanted. Meanwhile, the stop key 363 cannot be inserted at the time of inserting the stop blade. Therefore, after a stop blade 360*a* is inserted into the groove portion, it is fixed with the adjacent turbine blades 360 by fastening screws 364 as shown in FIG. 18, and the stop blade 360*a* is prevented from moving in the axial direction.

As to the vibration design, if the turbine blade stands solely, there are large numbers of vibration modes which depend on the characteristics of the single blade. If vibratory force due to an external force such as steam power conforms to or comes close to such vibration modes, the resonant stress of the turbine blade becomes excessive, and if worst, it may result in breakage. Therefore, for example, JP-A 2000-18002 (KOKAI) designs to control the vibration modes according to a group blade structure which couples a plurality of the implanted turbine blades. According to JP-A 2004-52757 (KOKAI), it designs to control the vibration modes according to a perimeter group blade structure which couples all the turbine blades around the whole circumference.

As the perimeter group blade structure, there is a snubber structure that a shroud is provided at the tip end of a single blade, a working face is formed on the back side and ventral side of the shroud, and assembling is performed to contact one working face to the other working face of the adjacent turbine blade to configure the blades on the whole circumference as one group. In this snubber structure, vibration suppressing effect by friction of the snubber working face is high, and the number of vibration modes is limited because it is the perimeter group blade structure. Besides, since there is no a group head blade or a group tail blade different from the group blade structure, there is no significant point in the vibration modes, and a uniform vibration stress is produced in all the blades. Therefore, there are great benefits in view of the vibration suppressing design, such as easy control of vibration modes, and the snubber type blade is being used extensively.

If the adjacent snubbers are mutually contacted completely when the above snubber type blade implants the turbine blades into the groove portions, contact between the snubbers might become insufficient or a gap might be caused between the snubbers because the turbine blade body is floated upward or expanded by the centrifugal force, or differential thermal expansion or the like occurs between the turbine blades during the operation. If a gap is formed between the snubbers, vibration suppressing effect cannot be expected, and the turbine operation reliability is considerably deteriorated. Therefore, the conventional snubber type blade sometimes adopts a wedge-shaped snubber type that the standard rotor blade (ordinary blade) 370 and the offset rotor blade 380 from which expected is radial floating up by the centrifugal force are alternately arranged to aggressively contact the adjacent shroud portions 390 as shown in FIG. 19.

Control of a radial directional position of the snubber type blade to contact aggressively the shroud portion 390 is performed mainly by adjusting fitting gaps m, n, which are produced when blade root portions 370*a*, 380*a* are inserted into the groove portions formed in the rotor blade wheel 395 as shown in FIG. 20 and FIG. 21, to values different between the standard rotor blade 370 and the offset rotor blade 380.

Based on the two important design conditions of the strength design and vibration design described above, the latest turbines tend to adopt the axial inserted blade root type and the snubber type blade for the turbine blade of an important stage affecting the performance characteristics.

But, when the turbine blade is implanted by the turbine blade implanting method according to the above-described conventional axial inserted blade root type, it is relatively easy for the turbine blades other than the stop blade to conform the center of gravity of the blade root portion to the center of gravity line of the rotor blade by design calculation considering the stop key and its accompanying fixing structure portion. Meanwhile, for the stop blade, the rotor blade wheel and the axial end portion of the blade root portion are fixed by fastening screws, so that the effect against the centrifugal force is affected considerably.

When the above-described conventional wedge-shaped snubber type is adopted, it is necessary to accurately control the movements of the individual turbine blades in their radial directions, and designing, machining and assembling work must be performed with sufficient attention paid. Thus, it has a disadvantage that the production procedure becomes considerably complex. Especially, when operating, the centrifugal force applied to one turbine blade is also applied partly to the adjacent turbine blade via the shroud portion, so that the blade root portion of the adjacent turbine blade has a possibility of having a large stress, and both accurate design and exact assembling are required.

It has become apparent by accurate simulation calculation that when the above-described conventional snubber type blade is used, slight falling of the turbine blade caused at the time of assembling and increasing rotations, namely inclination, causes a nonuniform frictional force in the snubber, irregularities of the outer circumferential surface of the shroud, nonuniform stress or stress concentration caused in the hook portion of the blade root portion.

BRIEF SUMMARY OF THE INVENTION

The present invention provides a turbine blade assembly which can maintain uniformity of centrifugal field in the rotation direction (circumferential direction) without causing falling from a predetermined fixed position even when operating and can be assembled with high precision, and a steam turbine.

According to an aspect of the present invention, there is provided a turbine blade assembly, comprising a plurality of turbine blades each provided with a blade root portion, an effective blade part and a shroud sequentially in a blade height direction; and a turbine rotor having at least one blade wheel which is comprised of a plurality of blade grooves formed circumferentially around it, wherein: a blade cascade is circumferentially formed on the blade wheel by implanting the blade root portions of the turbine blades into the plurality of blade grooves formed in the blade wheel of the turbine rotor, the blade root portions of the turbine blades, comprising an embedding portion to be inserted into the blade grooves; a shank portion which is formed between the embedding portion and the effective blade part; and a center cutout portion which is formed in one circumferential side surface of the shank portion, wherein a stopper member, which prevents the turbine blade from moving in the axial direction of the turbine rotor, is inserted into each of the center cutout portions, and the shank portion of the turbine blade to be implanted last into the blade groove of the blade wheel, comprising an axial cutout portion which is formed from one end in the axial direction of the turbine rotor to the center cutout portion; and a through passage which is formed from the center cutout portion to the effective blade part, moves the stopper member toward the effective blade part within the center cutout portion and inserts therein a moving member which puts a side surface of the stopper member on the axial direction side of the turbine rotor and the inner wall surface of the center cutout portion into a contactable state.

According to another aspect of the present invention, there is provided a steam turbine, comprising a casing and the above-described turbine blade assembly disposed in the casing.

BRIEF DESCRIPTION OF THE DRAWINGS

The present invention is described with reference to the drawings, which are provided for illustration only and do not limit the present invention in any respect.

DETAILED DESCRIPTION OF THE INVENTION

The best mode of carrying out the present invention will be described below in detail with reference to the drawings.

Figure 1:
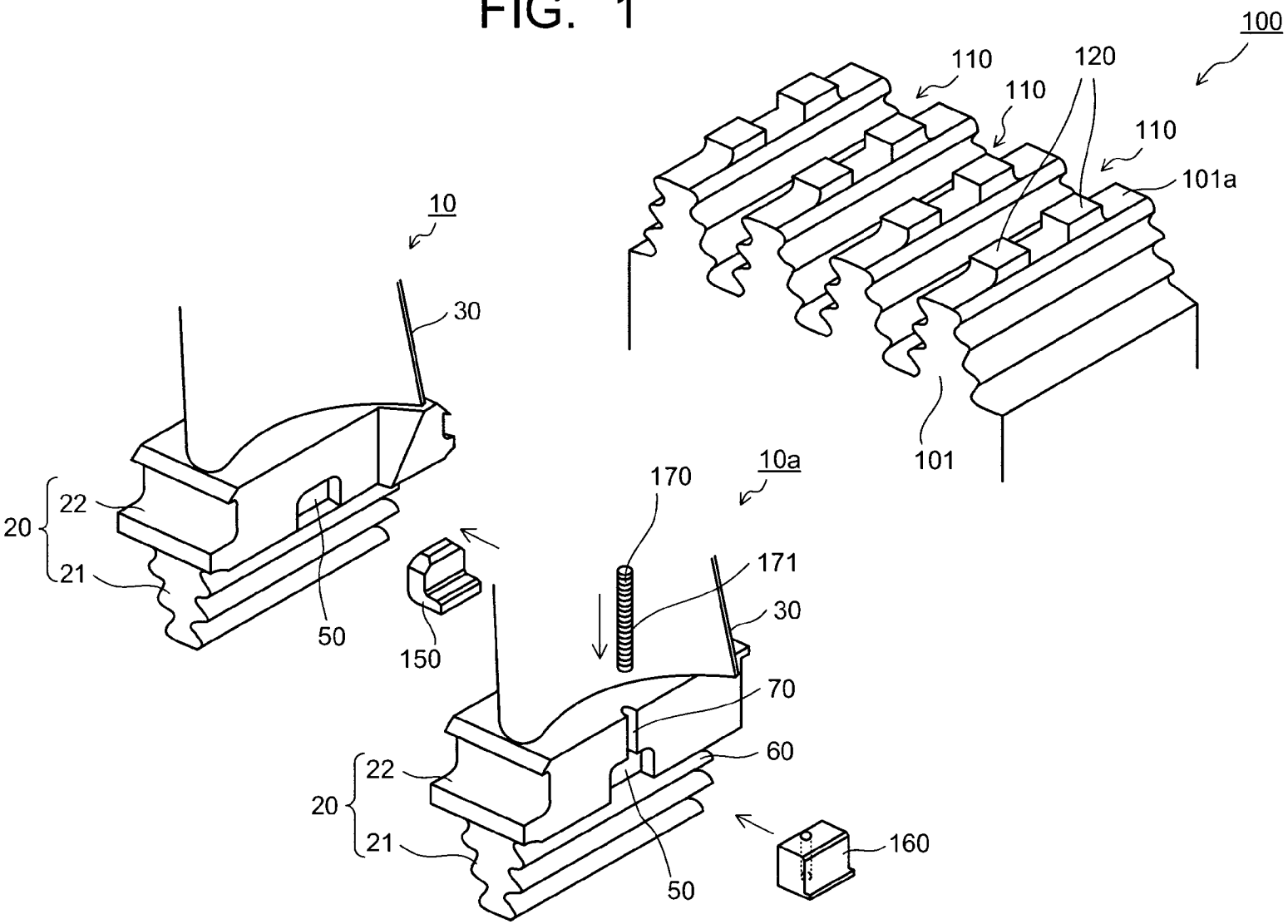
FIG. 1 is a perspective view showing structures of turbine blades and blade grooves of a turbine rotor according to an embodiment of the present invention.
Figure 2A:
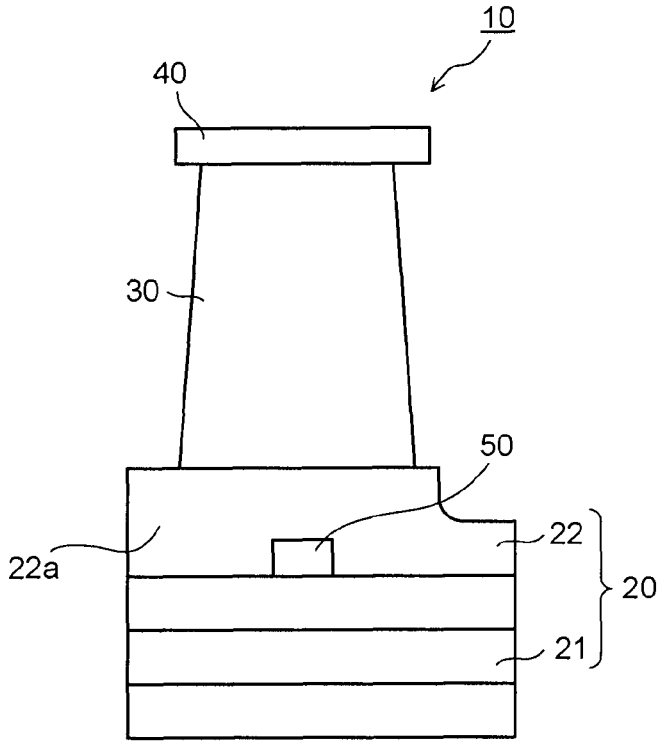
FIG. 2A is a plan view showing one circumferential side surface of a turbine blade other than the turbine blade to be implanted last into a blade groove.
Figure 2B:
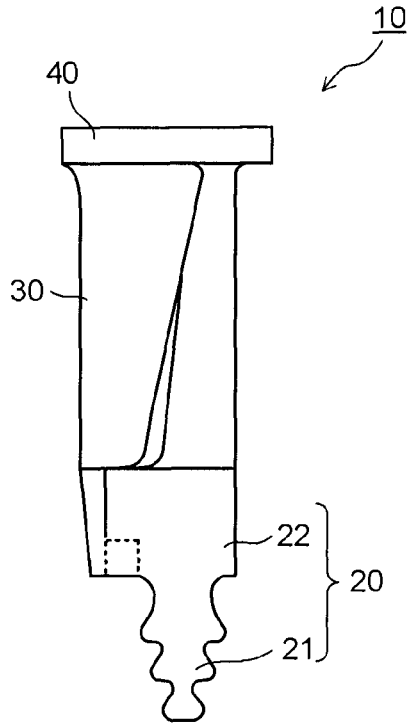
FIG. 2B is a plan view of the turbine blade shown in FIG. 2A viewed from the side inserting into the blade groove.
Figure 3A:
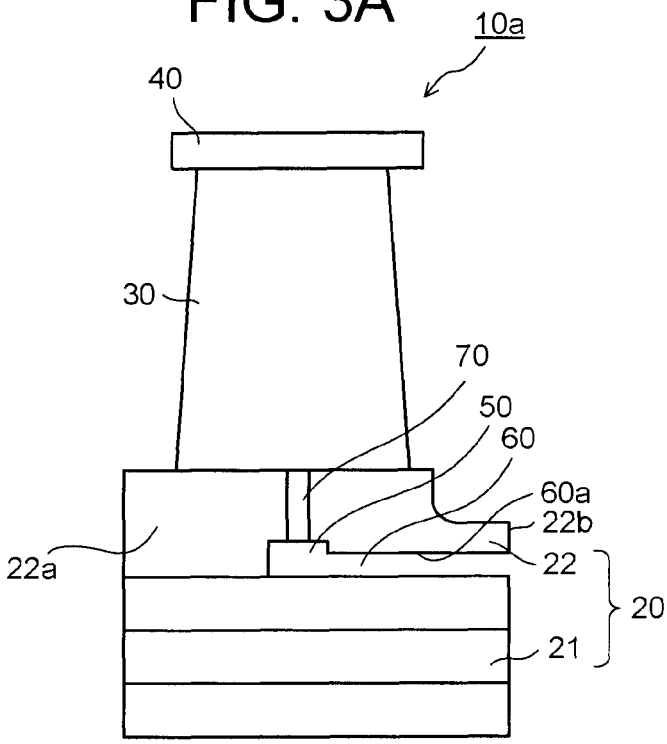
FIG. 3A is a plan view showing one circumferential side surface of the turbine blade to be implanted last into a blade groove.
Figure 3B:
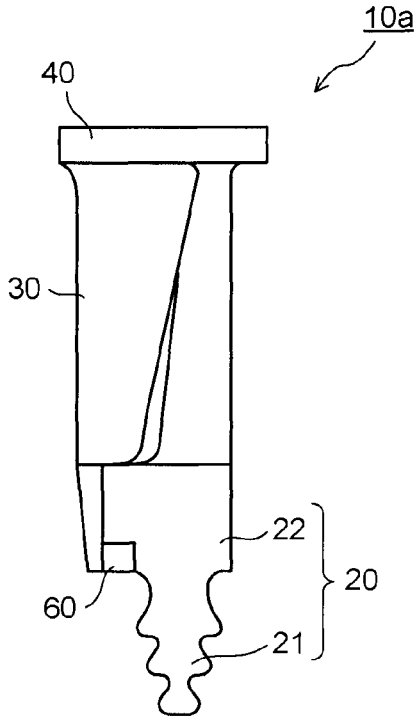
FIG. 3B is a plan view of the turbine blade shown in FIG. 3A viewed from the side inserting into the blade groove.

FIG. 1 is a perspective view showing structures of turbine blades 10, 10*a* and blade grooves 110 of a turbine rotor 100 according to an embodiment of the invention. FIG. 2A is a plan view showing one circumferential side surface of the turbine blade 10 other than the turbine blade to be implanted last into the blade groove 110. FIG. 2B is a plan view of the turbine blade 10 shown in FIG. 2A viewed from the side inserting into the blade groove 110. FIG. 3A is a plan view showing one circumferential side surface of the turbine blade 10*a* to be implanted last into the blade groove 110. FIG. 3B is a plan view of the turbine blade 10*a* shown in FIG. 3A viewed from the side inserting into the blade groove 110.

As shown in FIG. 1, the turbine blades 10, 10*a* are inserted into the blade grooves 110 formed in a rotor blade wheel 101 of the turbine rotor 100 and fixed by stopper members 150, 160 to form a blade cascade in a circumferential direction of the turbine rotor 100. Individual structures are described below.

As shown in FIG. 1 to FIG. 3B, the turbine blades 10, 10*a* are provided with a blade root portion 20, an effective blade part 30 and a shroud 40 sequentially along a blade height direction. The turbine blades 10, 10*a* are so-called axial inserted blade root type turbine blades which are arranged in plural in the circumferential direction of the turbine rotor 100 and inserted into the recessed blade grooves 110 of the rotor blade wheel 101 in an axial direction of the turbine rotor 100.

The blade root portion 20 is provided with an embedding portion 21 to be inserted into the blade groove 110 of the turbine rotor 100, and a shank portion 22 to be formed between the embedding portion 21 and the effective blade part 30.

The embedding portion 21 has a fitting concavo-convex shape of an axial inserted blade root type, and its fitting concavo-convex shape corresponds to the shape of the blade groove 110 of the turbine rotor 100. The fitting concavo-convex shape prevents the turbine blades 10, 10*a* from radially coming out of the turbine rotor 100.

The shank portion 22 has a cutout portion 50 formed in one circumferential side surface 22*a* of the shank portion 22 at the center in the axial direction of the turbine rotor 100 as shown in FIG. 2A and FIG. 3A. The cutout portion 50 is a groove for insertion of the stopper members 150, 160 to prevent the turbine blades 10, 10*a*, which are implanted in the blade grooves 110 of the turbine rotor 100, from moving in the axial direction of the turbine rotor 100. Structures of the stopper members 150, 160 will be described later. As shown in FIG. 3A, the turbine blade 10*a* to be implanted last into the blade groove 110, namely the so-called stop blade shank portion 22, is formed with a cutout portion 60, which is formed in one circumferential side surface 22*a* of the shank portion 22 from one end portion 22*b* to the cutout portion 50 in the axial direction of the turbine rotor 100. The shank portion 22 has a through passage 70 which is formed to pass from the cutout portion 50 toward the effective blade part. The through passage 70 is a passage for insertion of a moving member 170 for moving the stopper member 160 into the cutout portion 50.

As shown in FIG. 3A, a length in a blade height direction of the cutout portion 50 is larger than that in the blade height direction of the cutout portion 60. Namely, the cutout of the cutout portion 50 is more deeply formed in the blade height direction and has a stepped portion in the blade height direction at the boundary between the cutout portion 60 and the cutout portion 50. And, the width of the cutout portion 50 in the axial direction of the turbine rotor 100 is set to a level allowing the insertion of the stopper members 150, 160 described later. The width of the cutout portion 50 in the axial direction of the turbine rotor 100 is preferably determined to have specifically a minimum value allowing the insertion of the stopper members 150, 160. If the width of the cutout portion 50 in the axial direction of the turbine rotor is excessively larger than width M (see FIG. 4 and FIG. 5 described later) of the stopper members 150, 160, it is not desirable because the turbine blades 10, 10*a* are moved in the axial direction of the turbine rotor 100.

Figure 20:
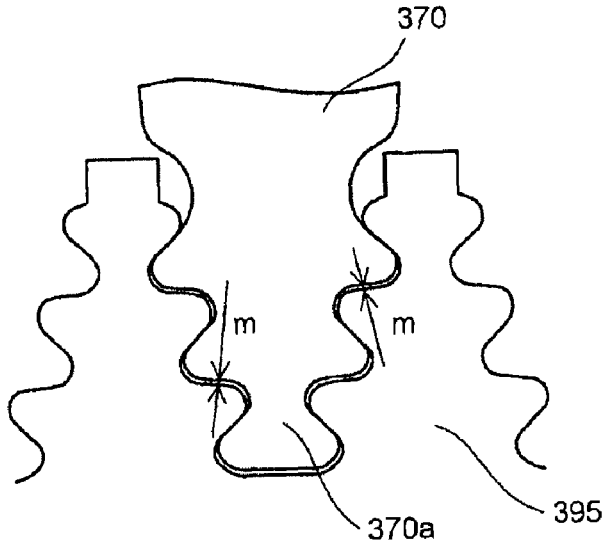
FIG. 20 Prior Art
FIG. 20 is a diagram showing a cross section of a blade root portion of a standard rotor blade and a rotor blade wheel having a structure to control a radial directional position of the snubber type blade.
Figure 21:
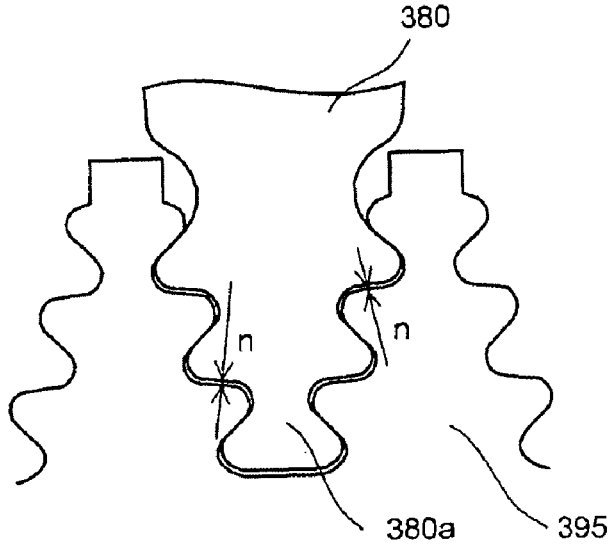
FIG. 21 Prior Art
FIG. 21 is a diagram showing a cross section of a blade root portion of an offset rotor blade and the rotor blade wheel having a structure to control a radial directional position of the snubber type blade.

The turbine blades 10, 10*a* have the shroud 40 on their tip ends and a working face formed on the back side and ventral side of the shroud 40, so that one of the working faces is contacted to the other working face of the adjacent turbine blades 10, 10*a*. The known wedge-shaped snubber blade method described above is adopted here to configure the turbine blades alternately as the standard rotor blades and the offset rotor blades. Similar to the above-described known technologies shown in FIG. 20 and FIG. 21, each space in the fitting concavo-convex shape between the embedding portion 21 and the blade groove 110 is determined to have a different value between the standard rotor blade and the offset rotor blade. By configuring in this way, the contact surface pressure between the shrouds 40 under centrifugal force during the operation can be made uniform along the whole circumference.

A structure of the turbine rotor 100 in which the turbine blades 10, 10*a* are implanted is described below.

As shown in FIG. 1, the turbine rotor 100 is formed with at least one row of the rotor blade wheels 101 which are formed with plural blade grooves 110, which are formed to have a recessed shape in the axial direction of the turbine rotor 100, formed along the circumferential direction of the turbine rotor. The blade grooves 110 formed in the rotor blade wheels 101 have a fitting concavo-convex shape. And, two projections 120 are formed with a predetermined space between them on each top 101*a* of the rotor blade wheels 101 between the blade grooves 110.

FIG. 1 shows the rotor blade wheel 101 which configures a stage of a single turbine rotor cascade. The rotor blade wheel 101 formed in the circumferential direction of the turbine rotor 100 is formed in plural stages in the axial direction of the turbine rotor 100 depending on the number of stages of the configuring turbine rotor cascade.

The stopper members 150, 160 are described below.

Figure 4:
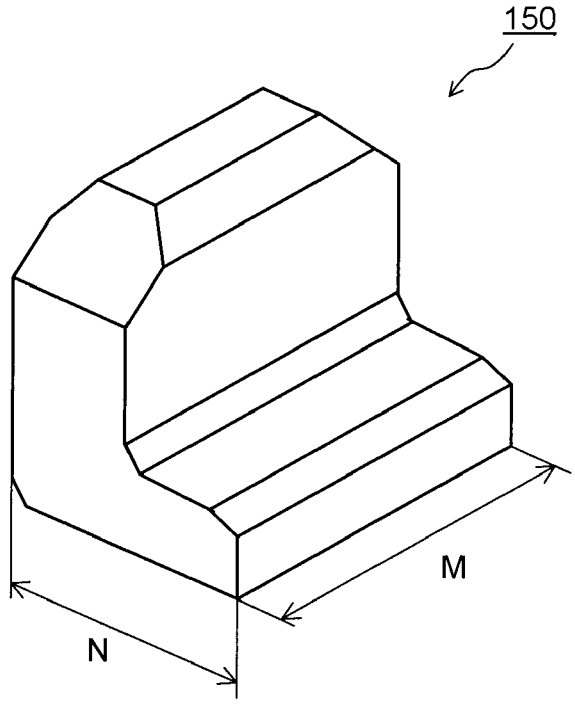
FIG. 4 is a perspective view showing a structure of a stopper member.
Figure 5:
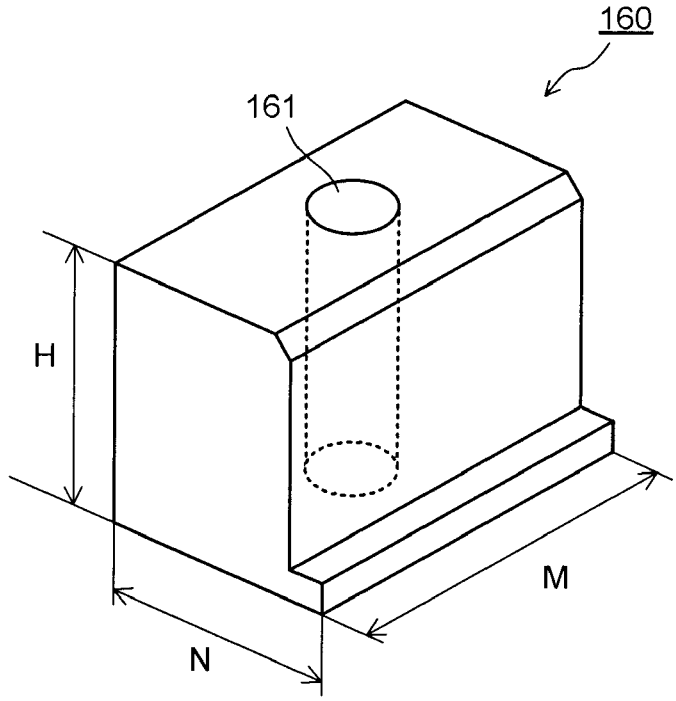
FIG. 5 is a perspective view showing a structure of a stopper member.

FIG. 4 is a perspective view showing a structure of the stopper member 150. FIG. 5 is a perspective view showing a structure of the stopper member 160.

As shown in FIG. 4 and FIG. 5, the stopper members 150, 160 are configured of, for example, an L-shaped member having a predetermined width M in the axial direction of the turbine rotor 100.

The width M of the stopper members 150, 160 is preferably set to a maximum value capable of inserting the stopper members 150, 160 between the two projections 120 formed on the top 101*a* of the rotor blade wheel 101 between the blade grooves 110. If the width M of the stopper members 150, 160 is excessively smaller than the gap between the two projections 120 formed on the top 101*a* of the rotor blade wheel 101 between the blade grooves 110, the stopper members 150, 160 are moved in the axial direction of the turbine rotor 100. It is not desirable because their movements cause the turbine blades 10, 10*a* to move in the axial direction of the turbine rotor.

Depth N of the stopper members 150, 160, which is perpendicular in the width direction of the stopper members 150, 160, is set so that one end portion in the depth direction is positioned between the two projections 120, and the other end is positioned in the cutout portion 50. It is preferable that the other end surface of the other end is set to come into contact with the side surface of the cutout portion 50 in the depth direction.

When the turbine blade 10*a* to be implanted last in the blade groove 110 is inserted into the blade groove 110, the stopper member 160 is arranged between the two projections before the turbine blade 10*a* is inserted. And, it is configured to avoid a contact with the stopper member 160 when the turbine blade 10*a* is inserted into the blade groove 110 by means of the cutout portion 60 formed in one circumferential side surface 22*a* of the shank portion 22 of the turbine blade 10*a* to be implanted last in the blade groove 110. Therefore, height H of the stopper member 160 is configured to be smaller than that of the cutout portion 60 in the blade height direction. In other words, the height H of the stopper member 160 is configured to be smaller than a distance between the surface of the top 101*a* of the rotor blade wheel 101 between the blade grooves 110 and a top surface 60*a* (see FIG. 3A) of the cutout portion 60 opposite to the former surface when the turbine blade 10*a* is inserted into the blade groove 110.

The stopper member 160 is formed with a threaded hole 161 in a direction of the height H of the stopper member 160. The threaded hole 161 is formed to be screwed with a screw thread 171 of the moving member 170 which is configured of a cylindrical member which has the screw thread 171 formed on its peripheral surface.

A process of implanting the turbine blades 10, 10*a* into the turbine rotor 100 is described below.

Figure 6:
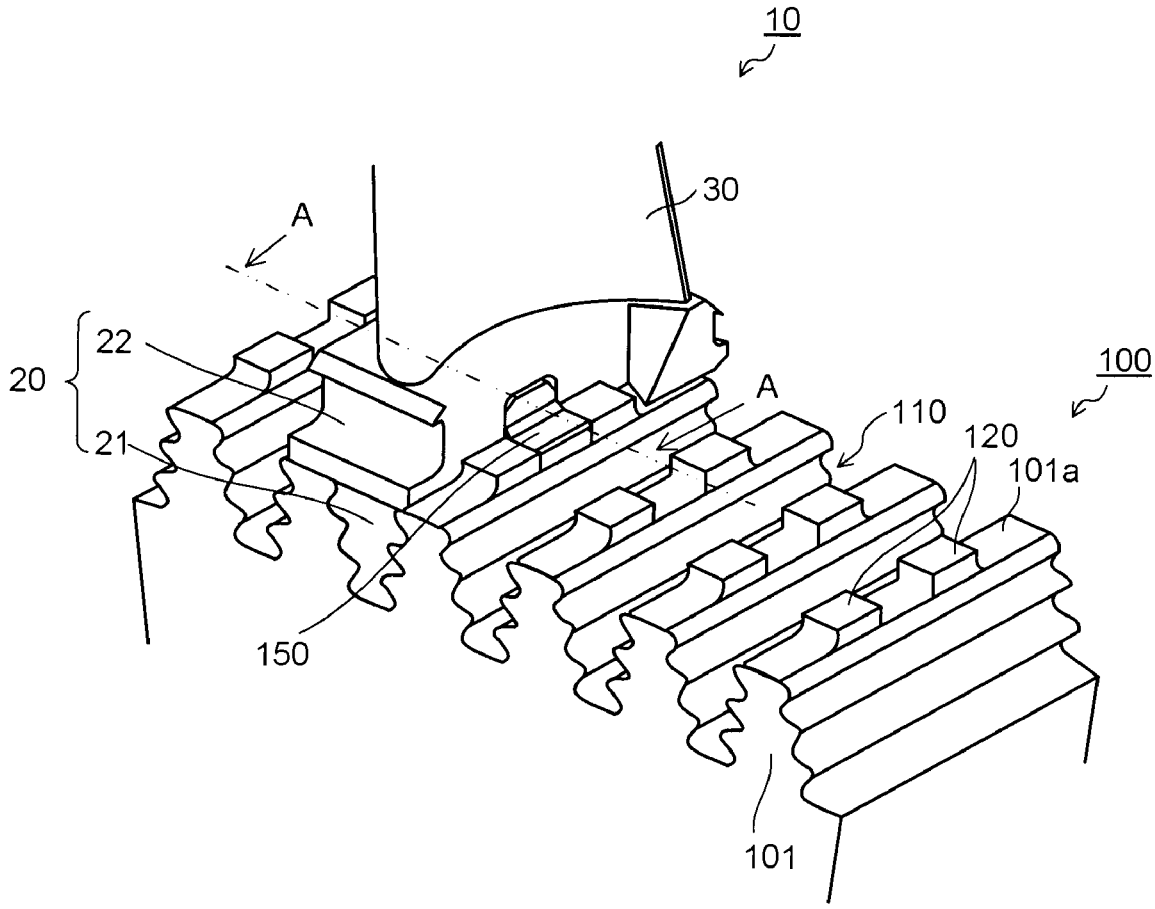
FIG. 6 is a perspective view showing a state that the turbine blade first inserted into a blade groove is fixed by a stopper member.
Figure 7:
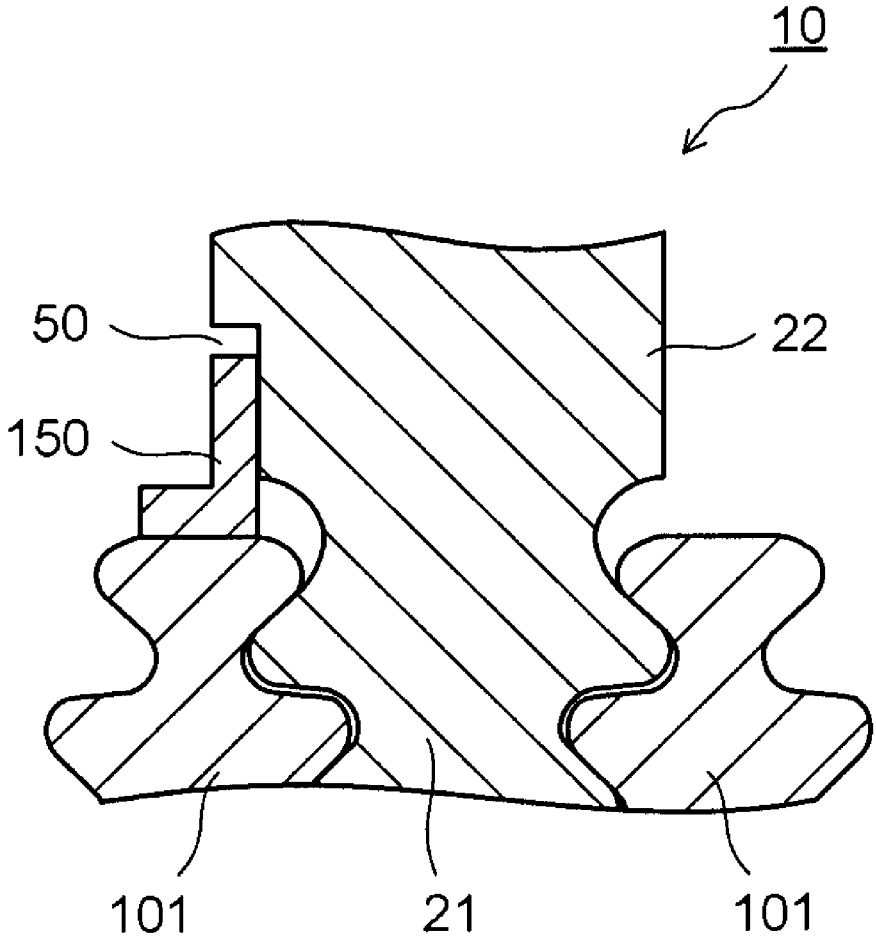
FIG. 7 is an A-A sectional view of FIG. 6 showing a portion where the stopper member is mounted.
Figure 8:
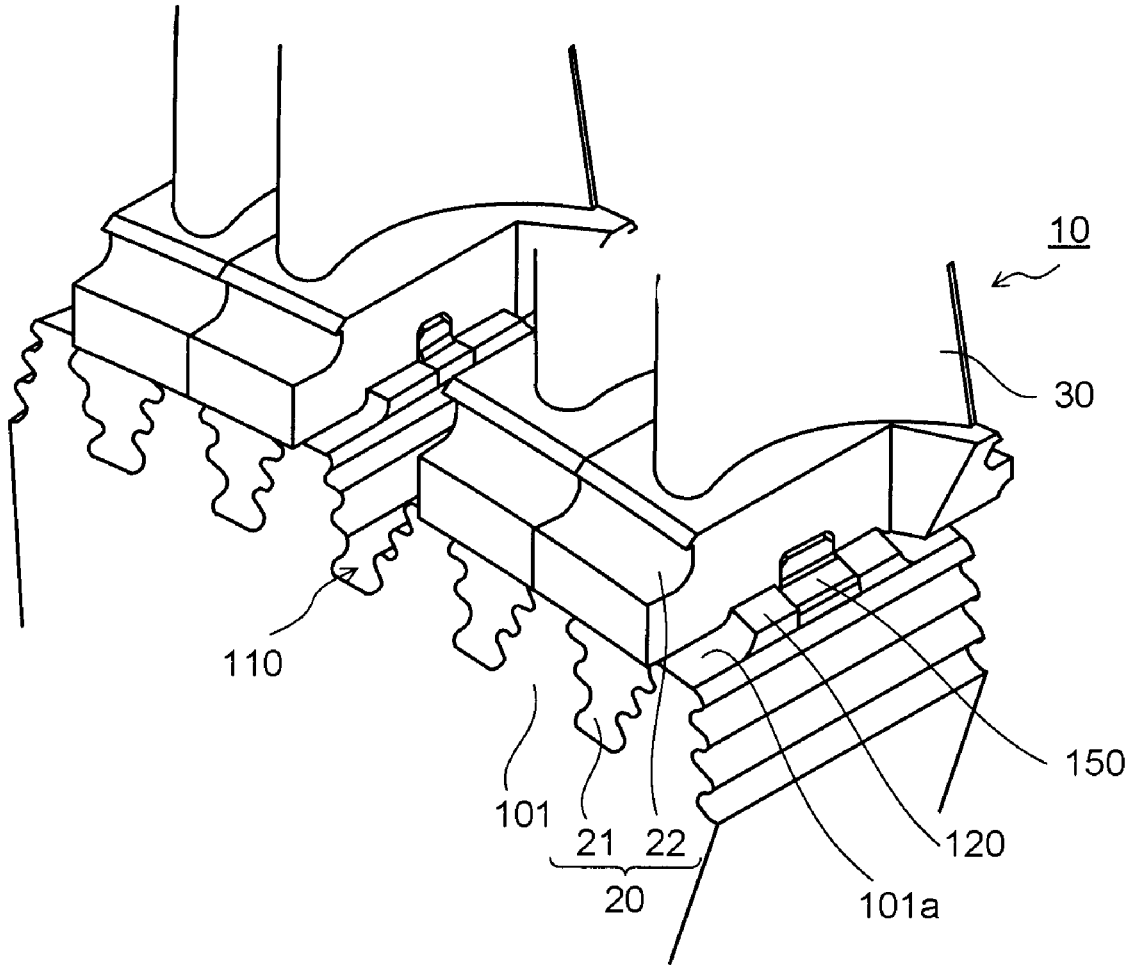
FIG. 8 is a perspective view showing a state that turbine blades other than the turbine blade which is implanted last are implanted.
Figure 9:
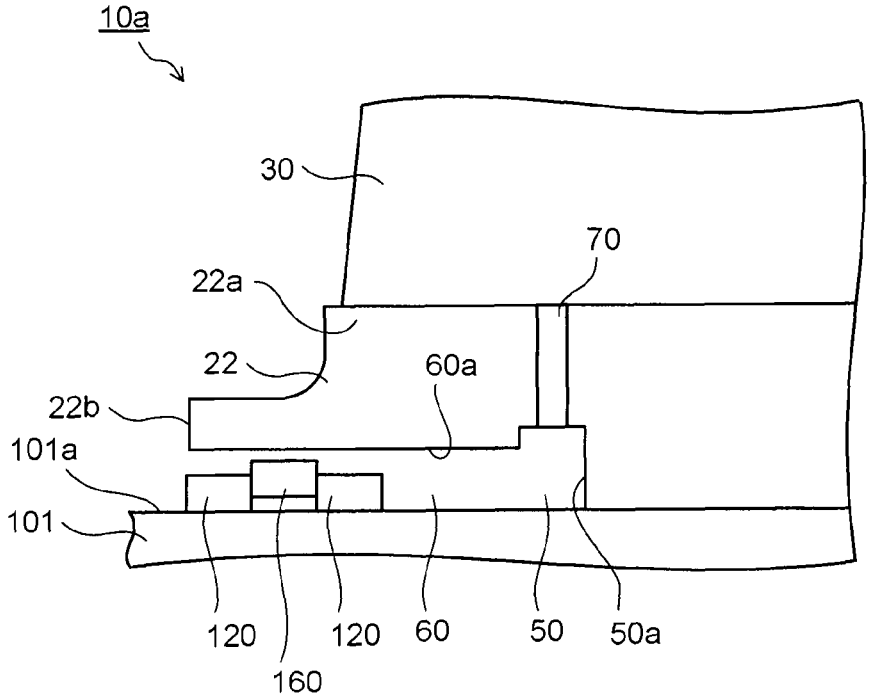
FIG. 9 is a plan view of a state that the turbine blade to be implanted last is inserted into a blade groove and pushed in the turbine rotor axial direction, viewed from the circumferential side surface.
Figure 10:
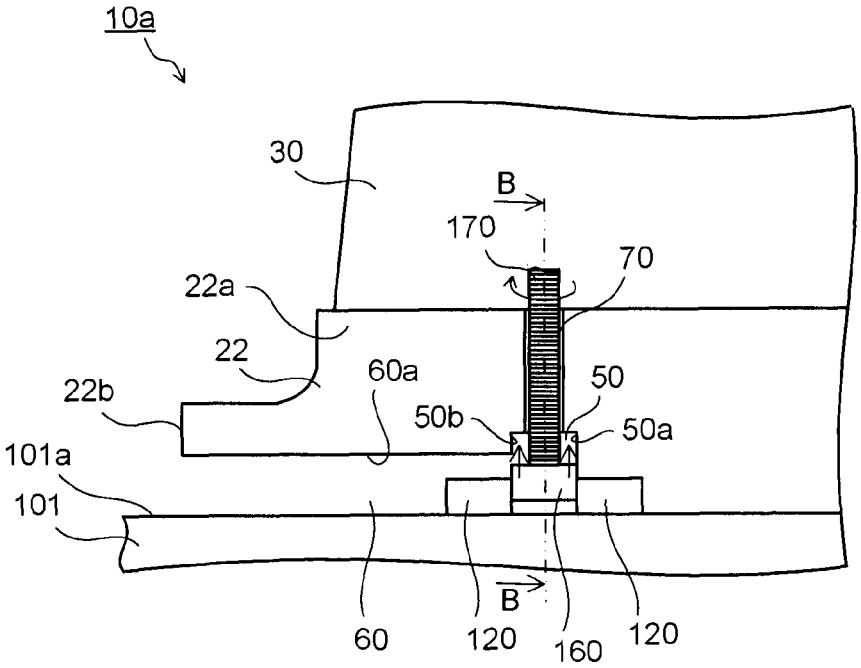
FIG. 10 is a plan view of a state that the turbine blade to be implanted last is inserted into a blade groove and a stopper member is moved, viewed from the circumferential side surface.
Figure 11:
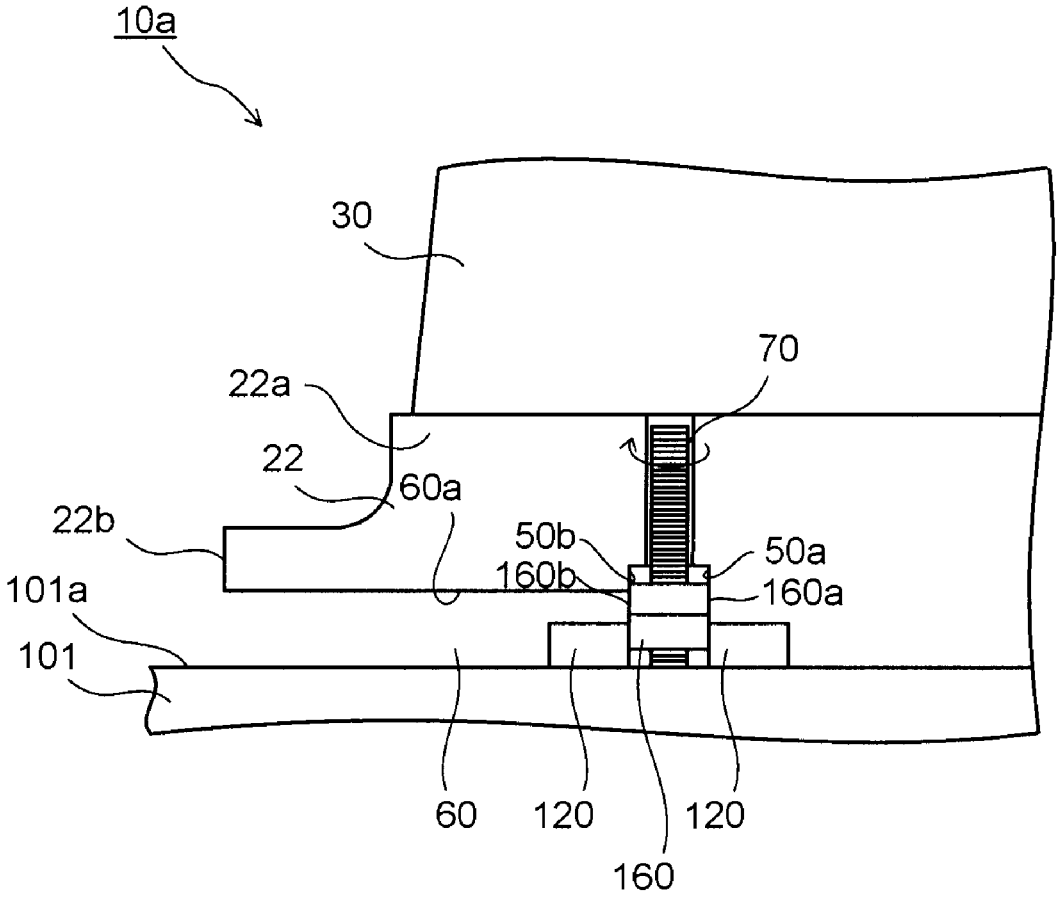
FIG. 11 is a plan view showing a state that the turbine blade to be implanted last is inserted into a blade groove and a stopper member is moved, viewed from the circumferential side surface.
Figure 12:
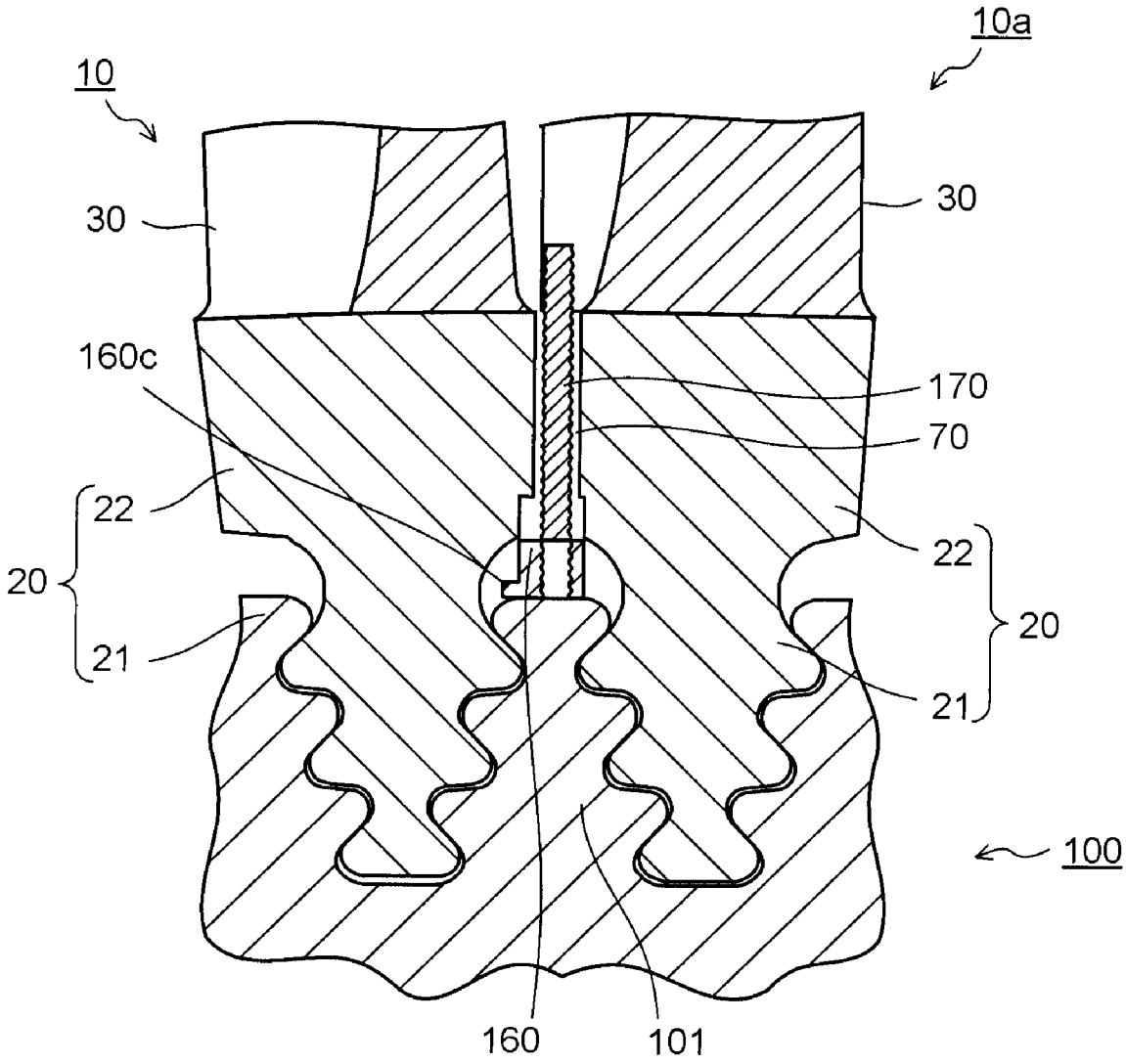
FIG. 12 is a diagram showing a B-B sectional view of FIG. 10.

FIG. 6 is a perspective view showing a state that the turbine blade 10 inserted first into the blade groove 110 is fixed by the stopper member 150. FIG. 7 is a cross section of line A-A of FIG. 6 showing a part where the stopper member 150 is mounted. FIG. 8 is a perspective view showing a state that the turbine blades 10 other than the turbine blade 10*a* to be implanted last are implanted. FIG. 9 is a plan view showing a state that the turbine blade 10*a* to be implanted last is inserted into the blade groove 110 and pushed in the axial direction of the turbine rotor 100 viewed from the circumferential side surface. FIG. 10 and FIG. 11 are plan views showing states that the turbine blade 10*a* to be implanted last is inserted into the blade groove 110 and the stopper member 160 is moved, viewed from the circumferential side surface. FIG. 12 is a diagram showing a B-B cross section of FIG. 10.

First, the turbine blade 10 is inserted into the blade groove 110 and pushed to reach a predetermined position, namely a position between two projections 120 where the cutout portion 50 is positioned. Subsequently, as shown in FIG. 6 and FIG. 7, the stopper member 150 is inserted between the projections 120 and into the cutout portion 50. The insertion of the stopper member 150 prevents the turbine blade 10 from moving in the axial direction of the turbine rotor 100. In a process similar to the above, the turbine blades 10 other than the turbine blade 10*a* to be implanted last are implanted.

Subsequently, the stopper member 160 is mounted at a predetermined position by inserting between the two projections 120 which are formed on the top 101*a* of one rotor blade wheel 101 configuring the last remained blade groove 110. As shown in FIG. 12, positioning of the stopper member 160 in the circumferential direction is performed by, for example, contacting to the shank portion 22 of the turbine blade 10 adjacent to the turbine blade 10*a*.

Subsequently, the turbine blade 10*a* to be implanted last is inserted into the remained last one blade groove 110. As shown in FIG. 9, the cutout portion 60 is formed in one circumferential side surface 22*a* of the shank portion 22 from the one end portion 22*b* in the axial direction of the turbine rotor 100 to the cutout portion 50. Therefore, the turbine blade 10*a* can be inserted without coming into contact with the stopper member 160 mounted between the projections 120. The insertion is stopped when a side surface 50*a* on the inserting direction side of the cutout portion 50 of the turbine blade 10*a* comes to a position to contact with the stopper member 160.

Subsequently, the moving member 170 is inserted from the effective blade part 30 side into the through passage 70, and inserted into the threaded hole 161 of the stopper member 160 positioned in its inserting direction and rotated in a prescribed direction. This rotation causes to threadably mount the moving member 170 and the threaded hole 161 so as to rotate the moving member 170, and the stopper member 160 is moved to the through passage 70 side (in the arrow direction in FIG. 10), namely to the effective blade part 30 side as shown in FIG. 10. And, as shown in FIG. 11, the end surface of the stopper member 160 on the side of the through passage 70 is moved toward the through passage 70 over the stepped portion in the blade height direction which is formed at the boundary between the cutout portion 60 and the cutout portion 50. Thus, both side surfaces 160*a*, 160*b* in the axial direction of the turbine rotor 100 of the stopper member 160 come into contact with side surfaces 50*a*, 50*b* in the axial direction of the turbine rotor 100 of the cutout portion 50. Therefore, the turbine blade 10*a* falls in a state that it cannot move in the axial direction of the turbine rotor 100.

As shown in FIG. 12, a projection 160*c* may be formed on a portion located on the rotor blade wheel 101 side on the side surface in one circumferential direction of the stopper member 160. Since the projection 160*c* can be seen from the axial direction side of the turbine rotor 100 at the time of moving the stopper member 160, the stopper member 160 can be moved while checking the moving position of the stopper member 160. And, it is preferable that the moving member 170 is housed within the through passage 70 without protruding from the shank portion 22 toward the effective blade part 30 after the stopper member 160 is moved in order to prevent erosion by steam and the like. To prevent the turbine blades 10, 10*a* from being inserted into the blade grooves 110, particularly in an inclined form in the circumferential direction of the turbine rotor 100, it is preferable that the turbine blades 10, 10*a* are fixed at positions where the blade grooves 110 in which the turbine blades 10, 10*a* are inserted become vertically lower parts, namely positions where the blade grooves 110 are opened at vertically lower parts.

In the above process, the turbine blades 10, 10*a* are implanted into the blade grooves 110 of the turbine rotor 100 to form a blade cascade in the circumferential direction of the turbine rotor 100.

As described above, the turbine blades 10, 10*a* according to an embodiment of the present invention can maintain uniformity of the centrifugal field in the rotation direction (circumferential direction) of the turbine blades 10, 10*a* by forming the cutout portion 50 in one circumferential side surface 22*a* of the shank portion 22 of the turbine blades 10, 10*a* at the center in the axial direction of the turbine rotor 100, and fixing the turbine blades 10, 10*a* by the stopper member 160 using the cutout portion 50. Especially, the turbine blade 10*a* which functions as a stop blade can be fixed by the stopper member 160 and the moving member 170 by means of the cutout portion 50. Therefore, uniform centrifugal field in the rotation direction (circumferential direction) can be obtained in comparison with other conventional fixing methods. In addition, mechanical strength of a fixing portion is also improved in comparison with the conventional axial inserted blade root type turbine blade which has, for example, the stop blade in the axial direction of the turbine rotor fixed by screwing. Especially, the fixing force in the axial direction of the turbine rotor by the shroud (snubber) cannot be expected for the snubber blade type turbine blade, so that the improvement of the mechanical strength of the fixing portion improves its reliability as the stage blade. And, the turbine blade has the main portion of the disconnection preventive structure of the turbine rotor in the axial direction arranged at a position where it is not exposed to steam or the like, so that erosion and the like can be prevented.

The adoption of the axial inserted blade root type turbine blades 10, 10*a* enables to prevent the turbine blades 10, 10*a* from falling in the axial direction of the turbine rotor 100. Besides, the turbine blades 10, 10*a* are fixed at a position where the blade grooves 110, into which the turbine blades 10, 10*a* are inserted, become vertically lower parts, namely positions where the blade grooves 110 are opened at vertically lower parts. Thus, the turbine blades 10, 10*a* can be prevented from falling in the circumferential direction of the turbine rotor 100.

The fixing structures of the turbine blades 10, 10*a* were mainly described above. And, it is preferable that the turbine blades 10, 10*a* have the structures described below.

Figure 13:
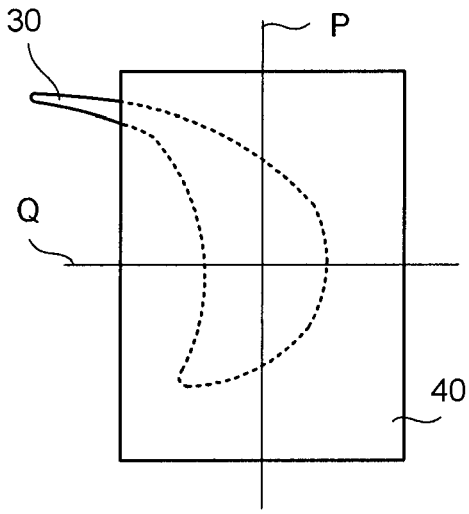
FIG. 13 is a plan view of a turbine blade viewed from a direction of inserting into a blade groove.
Figure 13:
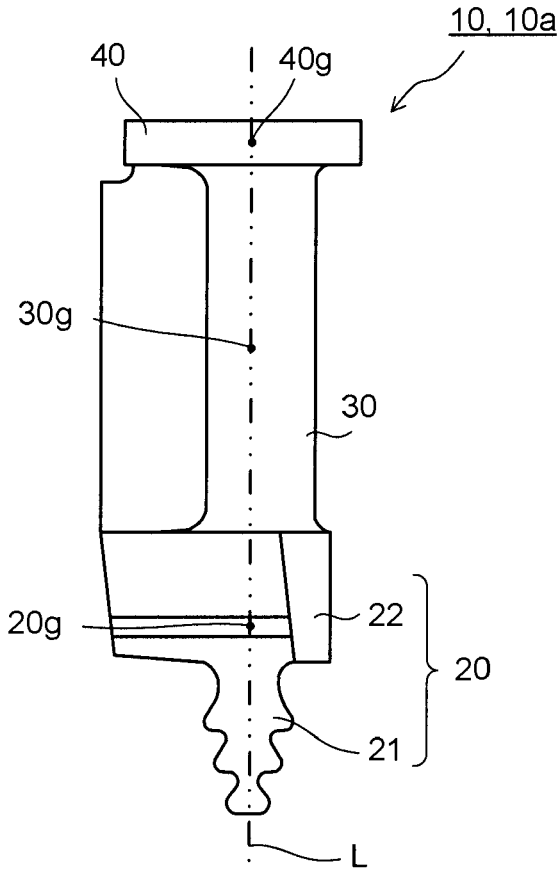
Figure 14:
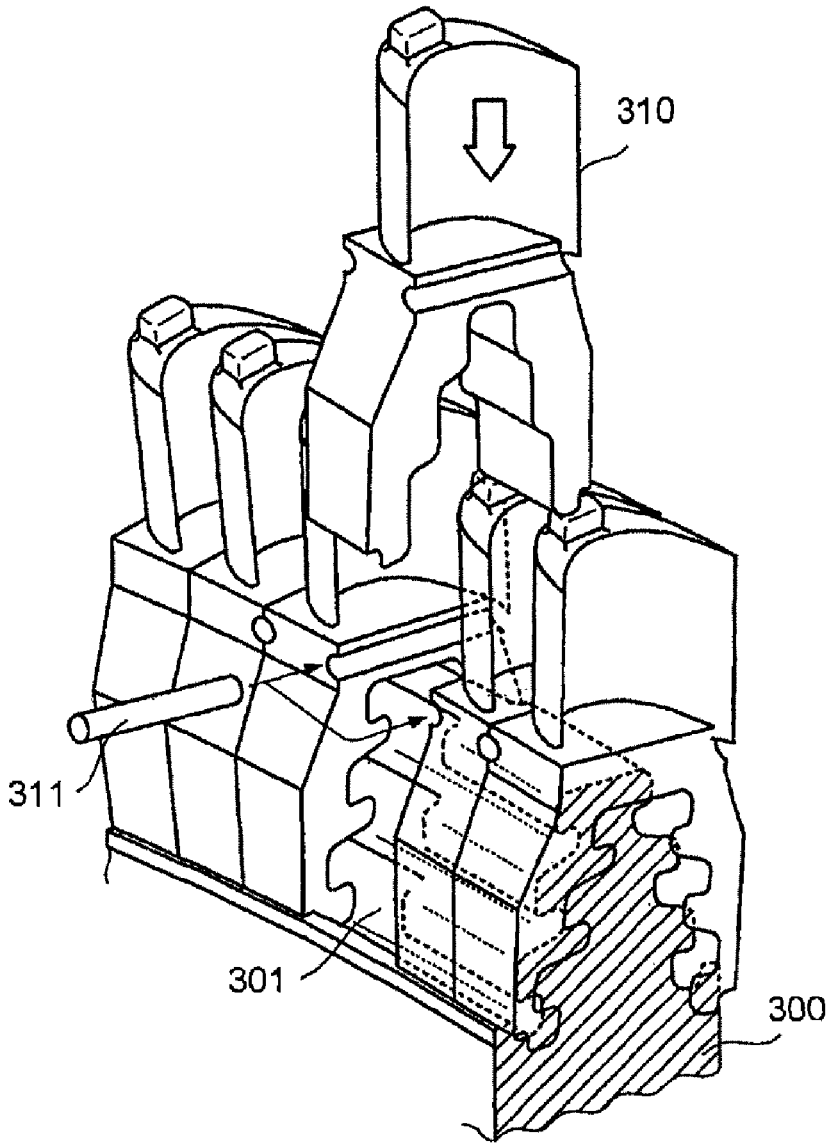
FIG. 14 Prior Art
FIG. 14 is a perspective view showing a rotor blade wheel and turbine blades to illustrate a blade root fitting structure according to a conventional saddle-shaped blade root type.
Figure 15:
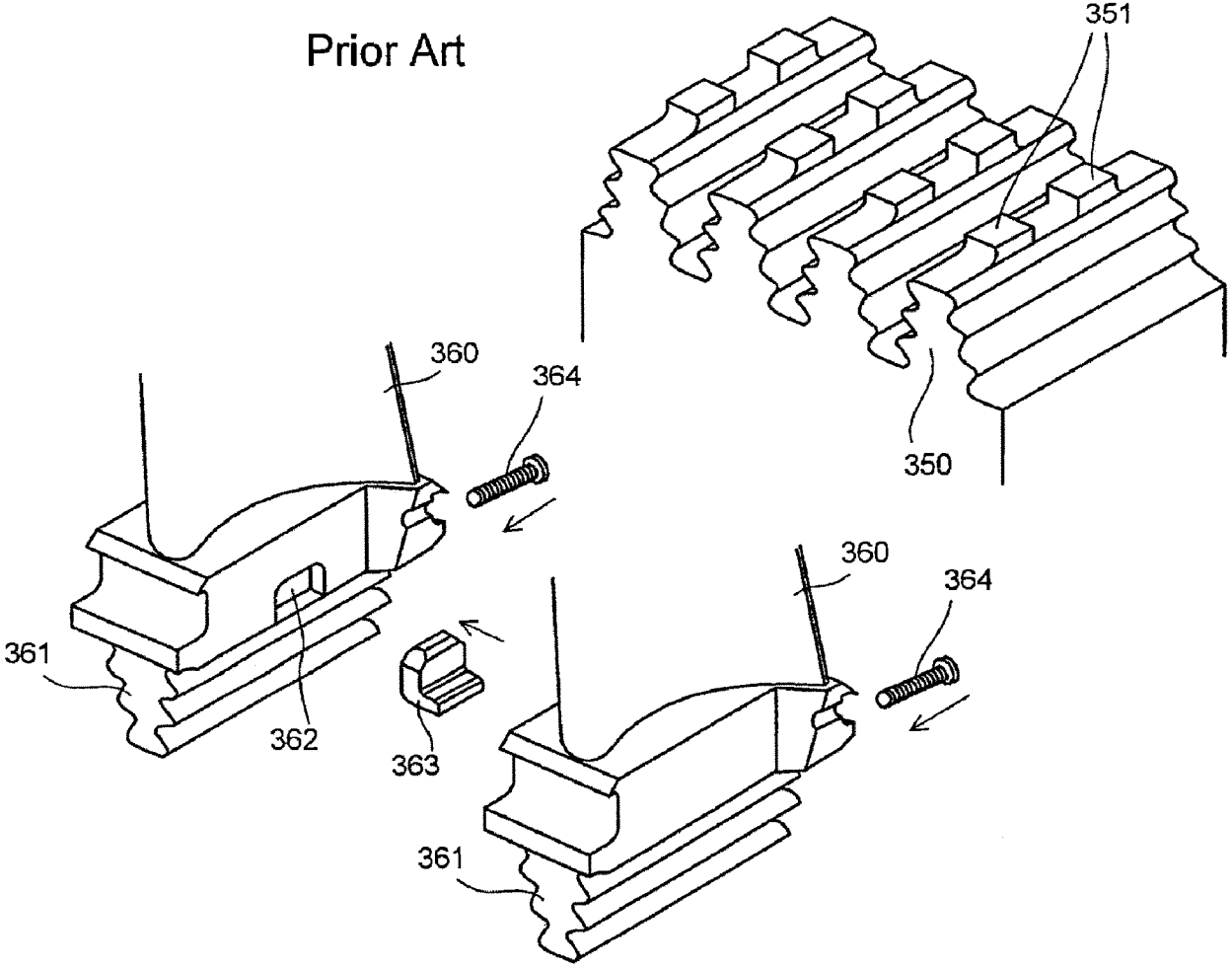
FIG. 15 Prior Art
FIG. 15 is a perspective view showing a rotor blade wheel and turbine blades to illustrate a blade root fitting structure according to a conventional axial inserted blade root type.
Figure 16:
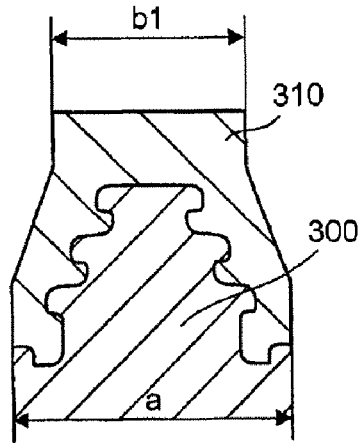
FIG. 16 Prior Art
FIG. 16 is a diagram showing a cross section of the rotor blade wheel and the turbine blade according to the conventional saddle-shaped blade root type viewed in a turbine rotor axial direction.
Figure 17:
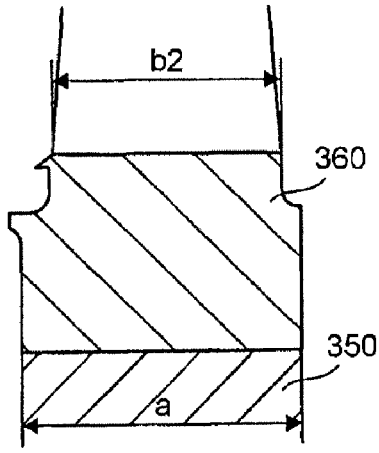
FIG. 17 Prior Art
FIG. 17 is a diagram showing a cross section of the rotor blade wheel and the turbine blade according to the conventional axial inserted blade root type viewed in a turbine rotor axial direction.
Figure 18:
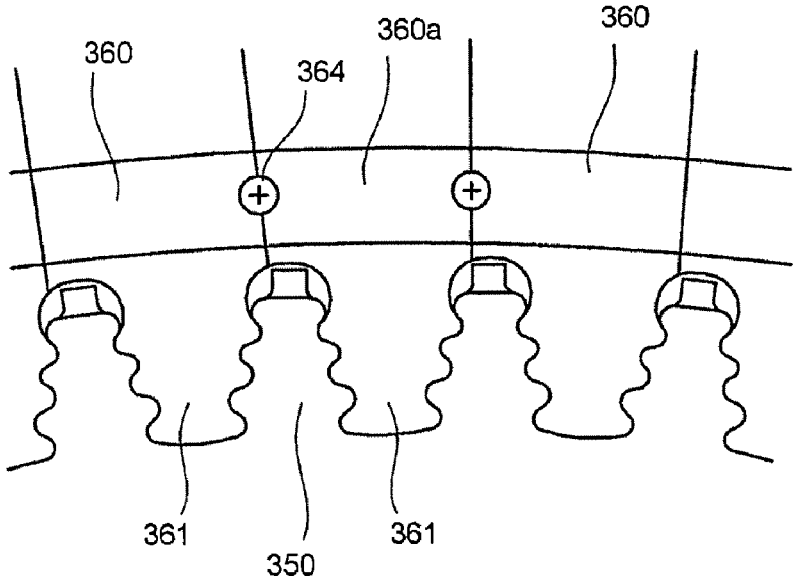
FIG. 18 Prior Art
FIG. 18 is a plan view of the rotor blade wheel and the turbine blades with stop blades fixed with screws viewed in the turbine rotor axial direction according to the conventional axial inserted blade root type.
Figure 19:
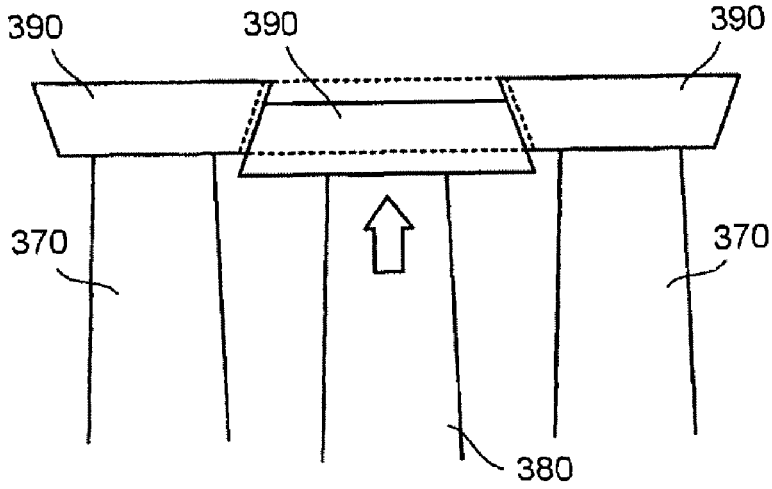
FIG. 19 Prior Art
FIG. 19 is a plan view showing a structure of shroud portions according to a conventional snubber type blade.

FIG. 13 is a plan view showing the turbine blades 10, 10*a* which are viewed from the direction that they are inserted into the blade grooves 110.

As shown in FIG. 13, it is preferable that centers of gravity 20*g*, 30*g*, 40*g* of the blade root portion 20, the effective blade part 30 and the shroud 40 of the turbine blades 10, 10*a* are positioned on a cross line L between a plane P which equally divides the blade root portion 20 into two in the circumferential direction of the turbine rotor 100 and a plane Q which equally divides the blade root portion 20 into two in the axial direction of the turbine rotor 100.

If at least one center of gravity of the blade root portion 20, the effective blade part 30 and the shroud 40 deviates from the cross line L, it is determined such that a combined center of gravity resulting from the combination of the centers of gravity 20*g*, 30*g*, 40*g* of the blade root portion 20, the effective blade part 30 and the shroud 40 is positioned on the cross line L. It is also preferable that when the turbine blades 10, 10*a* are implanted in the turbine rotor 100, it is determined such that the cross line L is positioned on the extended line in the radial direction of the turbine rotor 100.

As described above, the arrangement of the centers of gravity of 20*g*, 30*g*, 40*g* of the blade root portion 20, the effective blade part 30 and the shroud 40 of the turbine blades 10, 10*a* on the cross line L can prevent the turbine blades 10, 10*a*, which are the snubber blades having the axial inserted blade root type, from being fallen due to a load of blade centrifugal force.

Although the invention has been described above by reference to the embodiments of the invention, the invention is not limited to the embodiments described above. It is to be understood that modifications and variations of the embodiments can be made without departing from the spirit and scope of the invention.

What is claimed is:

1. A turbine blade assembly, comprising:

a plurality of turbine blades each provided with a blade root portion, an effective blade part and a shroud sequentially in a blade height direction; and a turbine rotor having at least one blade wheel which is comprised of a plurality of blade grooves formed circumferentially around the at least one blade wheel, wherein a blade cascade is circumferentially formed on the at least one blade wheel by implanting the blade root portions into the plurality of blade grooves, wherein the blade root portion comprises:

an embedding portion to be inserted into one of the plurality of blade grooves;

a shank portion which is formed between the embedding portion and the effective blade part; and a center cutout portion which is formed in one circumferential side surface of the shank portion;

wherein a stopper member, which prevents at least one of the plurality of turbine blades from moving in an axial direction of the turbine rotor, is inserted into the center cutout portion; and wherein the shank portion to be implanted last into at least one of the plurality of blade grooves, comprises:

an axial cutout portion formed from one end in the axial direction to the center cutout portion; and a through passage formed to receive a moving member from the center cutout portion to the effective blade part, the moving member being configured to be inserted into the through passage to move the stopper member toward the effective blade part within the center cutout portion so as to put a side surface of the stopper member on an axial direction side of the turbine rotor and an inner wall surface of the center cutout portion into a contactable state.

2. The turbine blade assembly according to claim 1, wherein the at least one blade wheel has two projections formed separately in the axial direction; and wherein the stopper member is arranged between the two projections and in the center cutout portion.

3. A steam turbine, comprising:

a casing; and the turbine blade assembly according to claim 1 disposed in the casing.

4. A steam turbine, comprising:

a casing; and the turbine blade assembly according to claim 2 disposed in the casing.

* * * * *